United States Patent [19]

Snyder

[11] 4,026,054

[45] May 31, 1977

[54] LASER AIMING SYSTEM FOR WEAPONS

[76] Inventor: Wesley L. Snyder, 8709 Robindell, Houston, Tex. 77036

[22] Filed: Feb. 2, 1976

[21] Appl. No.: 654,202

[52] U.S. Cl. ..... 42/1 A; 240/6.41; 331/94.5 T

[51] Int. Cl.[2] ..... F41G 1/34

[58] Field of Search ..... 33/235, 247, 248, 249; 42/1 ST, 1 A; 89/41 B; 240/2 F, 6.41; 331/94.5 T

[56] References Cited

UNITED STATES PATENTS

| | | | |
|---|---|---|---|
| 894,306 | 7/1908 | Wright | 240/6.41 |
| 1,042,551 | 10/1912 | Gray | 89/177 |
| 1,452,651 | 4/1923 | Norrlin | 240/6.41 |
| 2,422,767 | 6/1947 | Anderson | 89/177 |
| 3,153,856 | 10/1964 | Felix | 42/1 ST |

FOREIGN PATENTS OR APPLICATIONS

| | | | |
|---|---|---|---|
| 492,773 | 7/1919 | France | 33/247 |

OTHER PUBLICATIONS

Clair Rees, Guns, "The American 180 – New .22 SMG," pp. 45–47, Dec. 1973.

*Primary Examiner*—Stephen C. Bentley
*Attorney, Agent, or Firm*—Arnold, White & Durkee

[57] ABSTRACT

A laser aiming system for attachment to a conventional firearm such as a pistol, rifle or shotgun is disclosed, which system utilizes a laser to project a beam of a coherent light onto a target at a given range to indicate the impact point of a projectile fired from a weapon. The laser aiming system includes a laser tube, a self-contained power supply module and apparatus for mounting the laser to the weapon whereby the recoil force developed during firing of the weapon will not be injurious to the laser. The mounting apparatus includes a track fixed relative to the firearm with a carriage that is slidable thereon to provide limited longitudinal reciprocating movement of the laser relative to the weapon. A pneumatic device is operably disposed between the carriage and the weapon to absorb and dissipate the energy of recoil. Compression springs are provided and disposed on opposite sides of the carriage to yieldably resist longitudinal movement of the carriage and return it to an intermediate position on the track after recoil. An attachment mechanism releasably secures the mounting apparatus to the weapon.

10 Claims, 11 Drawing Figures

LASER AIMING SYSTEM FOR WEAPONS

BACKGROUND OF THE INVENTION

This invention relates generally to aiming devices for firearms and apparatus for mounting the same to a weapon, and more particularly to a laser aiming system having apparatus for mounting a laser to a weapon such that damage thereto from recoil developed upon the firing of the weapon is prevented.

Aiming devices are generally quite fragile. For example, telescopic sights employ a complex system of optics which can be easily damaged if subjected to great impact. Similarly, laser aiming devices are extremely fragile and would be seriously damaged by recoil if solidly affixed to the weapon. In order to prevent damage to a fragile aiming device, apparatus is required to absorb the recoil energy and reduce the shock to which the aiming device is subjected.

Recoil during the firing of a weapon occurs as a result of the weapon being accelerated rearwardly relative to its position prior to firing. Anything solidly affixed to the weapon will be subjected to the recoil of the weapon. Attempts to solve the problem of recoil damage to aiming devices, typically a telescopic sight, have followed the principle of permitting the aiming device to move relative to the weapon with some type of energy dissipating mechanism absorbing the energy created upon firing. Thus, upon being fired, the weapon would move rearwardly relative to the aiming device, preventing full impact of recoil from being applied to the aiming device.

One of the earliest mounting mechanisms using the relative sliding approach is the telescope sight for firearms patented by F. F. Burton in 1907 as U.S. Pat. No. 870,272. The apparatus disclosed by Burton comprises a telescopic sight that is free to slide with respect to its mounts on the weapon with recoil energy being dissipated through the friction developed between the mounts and the sight body.

A slightly more sophisticated system also employing a sliding mount for the aiming device is that disclosed in U.S. Pat. No. 1,641,019 issued to J. D. Woods. Woods discloses a gun sight which is slidably mounted in ring supports attached to the barrel of the weapon with a coil spring operably disposed between the sight and the forward support ring. In Woods, the coil spring permits rearward movement of the weapon with respect to the sight and returns the sight to its initial position after the recoil is dissipated. A similar approach implemented by different apparatus is the telescope mount of E. L. Livermore, which is the subject matter of U.S. Pat. No. 2,510,289. In the arrangement of Livermore, a quick disconnect telescope mount having shock absorbing capabilities is provided wherein the telescope sight is mounted for sliding movement with shock absorption resulting from the transmission of recoil forces from the weapon via a ring to a pin which is loaded by a spring. This mounting permits limited rearward movement of the weapon with respect to the sight with the spring returning the sight to its initial position after recoil.

Subsequent attempts to develop a mount for delicate aiming devices have retained the feature of providing the aiming device with movement relative to the weapon; however, the single shock absorbing mechanism has been replaced by fore and aft shock absorbing mechanisms. An example of this approach is the telescope sight mount of T. R. Felix disclosed in U.S. Pat. No. 2,597,466. In the apparatus disclosed, a clamp is rigidly secured to a slidable telescopic sight having a lug extending from the clamp that fits into a socket joint so as to move longitudinally with the sight. A pair of rubber blocks are positioned in the socket on opposite sides of the lug and function as shock absorbers to insulate the sight from the recoil force.

Illustrative of mounting apparatus using dual coil springs is the telscope sight mount of U.S. Pat. No. 3,153,856, also issued to T. R. Felix. The apparatus slidably mounts the aiming device with a lug being secured to the telescopic sight and logitudinally movable in a slot in the mount. A guide rod is disposed in the slot and firmly mounted at its ends to the mount body, with the mounting lug slidable thereon. A pair of compression springs are disposed about the rod on opposite ends thereof in engagement with the corresponding end of the slot and the face of the mounting lug opposing that end of the slot. By virtue of this arrangement, when the rifle is fired, or when some other shock is imposed on the stock, the telescopic sight can move longitudinally against the action of the springs, with the springs returning the sight to its initial position after recoil.

Although the prior art involves the mounting of optical aiming devices such as telescopic sights to firearms, it is also desirable to mount other types of aiming devices in a manner such that they are cushioned from the shock of recoil. In fact, the problem of damage due to recoil force becomes much more acute when other types of aiming devices, such as lasers, are used which are even more delicate than the optical telescopic sights. Typically, laser aiming devices will have miniature electronic components and other delicate internal components that may easily be damaged by the recoil of a conventional firearm, if the laser is rigidly mounted or otherwise not insulated from recoil.

A popular laser for use as an aiming device in conjunction with a conventional firearm such as a pistol or rifle is the helium neon laser. The popularity of the helium neon laser tube results from its relative inexpensiveness and also from the relative simplicity of its required power supply as compared to other types of laser tubes. However, the helium neon laser tube is one of the more delicate types of lasers primarily due to a glass capillary tube internal to the helium neon laser tube. If the laser tube is not cushioned from the shock of recoil, a resonant frequency may be set up in the glass capillary tube during firing of the weapon, causing the tube to break.

Another problem somewhat unique to laser aiming devices involves their ability to remain operative during automatic or rapid firing of the weapons to which they are attached. If the laser tube is not sufficiently insulated from the recoil forces of automatic firing, misalignment of mirrors internal to the laser can occur which causes the laser tube to flicker or possibly extinguish. If the tubes begin to flicker to extinguish, it is possible that the operator of the weapon will lose sight of his target.

Accordingly, it is desirable when using a laser as an aiming device to have an apparatus suitable for mounting the laser aiming device, particularly a helium neon laser tube, to a conventional firearm, such that the laser tube is insulated from the recoil of the weapon, thereby preventing damage to the laser tube and permitting continuous operation.

SUMMARY OF THE INVENTION

Lasers are precision instruments and must be carefully handled and protected from shock if the delicate internal components are to be maintained in proper working order. Accordingly, if a laser being used as an aiming device is rigidly mounted to a firearm, the recoil of the weapon upon being fired will be transmitted to the laser. Subjection of a laser to the recoil force of even a small caliber weapon will generally substantially destroy the laser.

Accordingly, it is the main feature of the invention to provide an apparatus for mounting a laser on a firearm for use as an aiming device in a manner whereby the recoil of the weapon will not be injurious to the laser.

A further feature of this invention, in accordance with the immediately preceding feature, is to provide a laser aiming system which may be readily utilized with various different types of firearms.

A still further feature of this invention is to provide a laser aiming system which is adapted to be releasably secured to a firearm.

In accordance with this invention, and in order to accomplish the above recited features, there is provided a laser aiming system which comprises a laser for projecting a beam of coherent light onto a target to identify the point of impact of a projectile fired from the weapon to which the laser is mounted, and an apparatus for mounting the laser to the weapon, whereby the laser is provided with limited movement longitudinally of the weapon with a pneumatic device cushioning the laser from shock upon recoil of the weapon.

In a more specific embodiment of the laser aiming system, there is provided a power supply module carried by the mounting apparatus for supplying electrical power to the laser. In a yet more specific embodiment of the present invention, the laser is a helium neon gas laser.

Specifically, the mounting apparatus of the instant invention comprises a mechanism providing the laser with longitudinal movement relative to the firearm. The mechanism includes an elongate guide that extends substantially parallel to the barrel of the weapon and a carriage adapted for sliding movement on the elongate guide. The mounting apparatus further includes a releasable attachment mechanism adapted to secure the elongate guide in fixed relation to the weapon and a holding mechanism attached to the carriage for holding the laser thereon. The pneumatic device that acts as a shock absorber is connected to the carriage and absorbs recoil energy.

In addition to the pneumatic device, the mounting apparatus may include a resilient mechanism to yieldably resist longitudinal movement of the carriage and urge the carriage to an intermediate position between the opposite ends of the elongate guide. Such a resilient mechanism might comprise a pair of compression springs disposed about the elongate guide on opposite sides of the carriage. It may be further desirable to pivotally attach the holding mechanism to the carriage, permitting the laser to be tilted in the vertical plane of the weapon with respect to the barrel and to be moved in the horizontal plane with the laser assuming an oblique disposition with respect to the barrel of the weapon. With the laser provided with such movement capability, windage and elevation adjustment mechanisms for sighting in the laser at a predetermined target range may be included in the mounting apparatus.

In a more specific embodiment of the present invention, the pneumatic device comprises a piston cylinder fixed relative to the laser, such as by attachment to the sliding carriage, with a piston disposed within the piston cylinder having a valve mechanism that is operable in response to fluid pressure buildup within the cylinder. A rod fixed relative to the weapon and extending through the piston cylinder has the piston secured thereon and serves to move the piston longitudinally within the piston chamber. The rod may be fixed relative to the weapon by a clamp secured to the elongate guide, which is itself fixed relative to the weapon.

Upon discharge of a firearm having a laser aiming system in accordance with the present invention mounted thereon, recoil of the weapon will drive the firearm rearwardly relative to the laser aiming device by virtue of the carriage sliding on the elongate guide. The compression springs will yieldably resist relative movement of the carriage with respect to the elongate guide and provide some cushioning from recoil shock. Movement of the elongate guide relative to the carriage results in a similar relative movement of the rod and piston within the piston cylinder of the pneumatic device. Fluid such as air contained within the piston cylinder resists movement of the piston causing pressure to be built up within the cylinder. Upon the fluid pressure attaining a predetermined level, a valve associated with the piston opens to controllably release fluid from within the piston cylinder, while still maintaining a yieldably resistant force opposing advancement of the piston. The pneumatic device absorbs recoil energy as it requires that the energy be expended in doing the work of moving the piston within the piston cylinder against the yieldable force of the compressed fluid within the piston cylinder. After weapon recoil is over, the compression springs serve to urge the carriage to an intermediate position between the opposite ends of the elongate guide.

BRIEF DESCRIPTION OF THE DRAWINGS

A more complete appreciation of the invention and many of the attendant features thereof will be readily appreciated as the same becomes better understood by reference to the following detailed description when considered in connection with the accompanying drawings in which like referenced characters designate identical or corresponding parts throughout the several views and wherein.

DESCRIPTION OF THE PREFERRED EMBODIMENT

Figure 1:
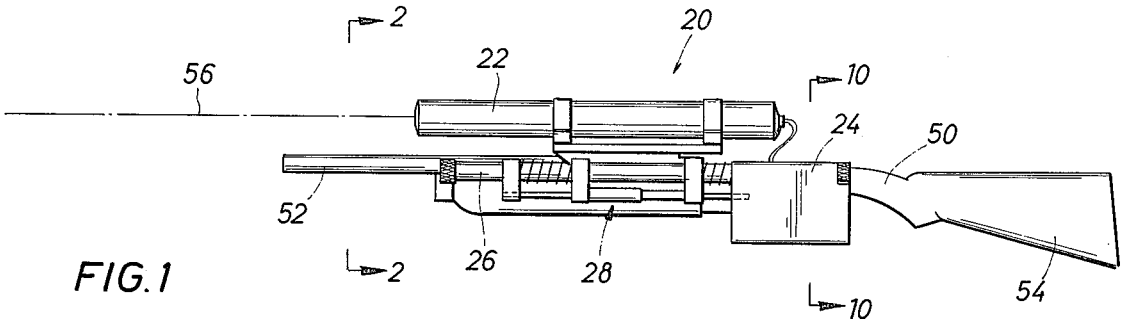
FIGS. 1 and 2 are elevation and frontal views respectively of one embodiment of the present invention mounted to a weapon, with FIG. 1 illustrating the longitudinal positioning of the illustrated embodiment on the weapon and FIG. 2 illustrating the lateral positioning of the illustrated embodiment with respect to the barrel of the weapon.
Figure 2:
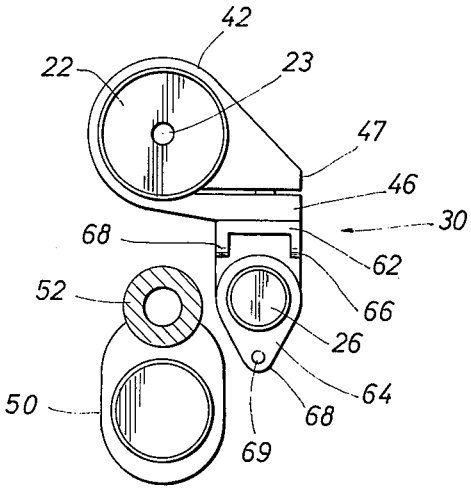

Referring now to the drawings, and more particularly to FIGS. 1 and 2 thereof, there is shown one embodiment of the laser aiming system, generally designated by the reference number 20, mounted to a weapon 50, a shotgun. As will be evident from the views of FIGS. 1 and 2, the laser aiming system 20 is mounted along the side of the weapon 50 with the laser head 22 extending above and substantially parallel with the elongate barrel 52 of the weapon. As will be further evident from the illustrated view of FIG. 1, the laser aiming system 20 is so mounted to the weapon 50 as to be disposed in a substantially central location between the end of the barrel 52 and the stock 54. The position of mounting relative to the ends of the weapon is important for best results since, during firing, forces are developed that are lateral and oblique to the longitudinal axis of the weapon, which oblique forces increase in magnitude toward the end of the barrel. Therefore, mounting of the laser aiming system in a more central location along the weapon tends to diminish the magnitude of the oblique forces acting on the laser head 22.

The laser head 22 utilized in the laser aiming system is preferably a helium neon laser. This type of laser is preferred for use with conventional firearms such as pistols, rifles and shotguns since it has relatively small power requirements and is relatively inexpensive, as compared with other types of lasers.

The laser head 22, as depicted in FIGS. 1 and 2, is mounted so as to be disposed directly above the barrel 52 of weapon 50. Although laser head 22 is substantially parallel to barrel 52, it is actually slightly off horizontal in order that the beam 56 of coherent light will, at the predetermined target range, be projected onto the target at the point of impact of a projectile fired from the weapon. The view of FIG. 2 shows that laser head 22 is mounted such that the opening 23 in laser head 22, through which light beam 56 is emitted, is disposed in a directly vertical disposition above barrel 52 with no lateral off-set.

The laser aiming system 20 shown mounted to the shotgun 50 includes a power supply module 24 supplied with electrical power from batteries housed in a a battery tube 26 that extends longitudinally of and is substantially parallel to the barrel 52 of the weapon. The battery tube 26 will typically house ten batteries, each being approximately 1.2 volts. Such power supply will provide power for approximately twenty minutes. Exact requirements for the power supply in other contexts of use will be determined by the particular laser tube being used.

Figure 3:
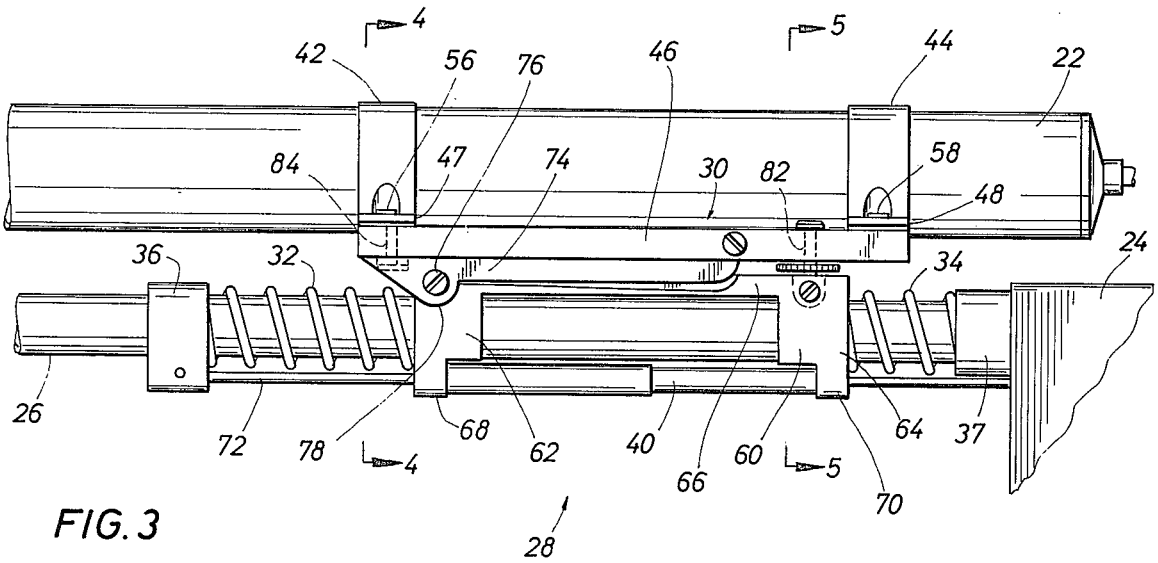
FIG. 3 is a close-up side view of the illustrated embodiment of the present invention detached from the weapon.

The laser aiming system 20 also includes mounting apparatus 28 for mounting the laser head 22 to the weapon 50 in a manner so as to reduce the recoil force transmitted to the laser head 22 upon firing of the weapon. In FIG. 3, mounting apparatus 28 is illustrated on a larger scale providing greater detail, with laser head 22 attached thereon. As shown in FIG. 3, and further illustrated in FIG. 2, the laser head 22 is attached to a laser head carriage 30 which is slidable along battery tube 26. The battery tube 26 constitutes an elongate guide track for carriage 30, and together these elements form a mechanism that provides limited longitudinal reciprocating movement of the laser head 22 relative to the weapon 50. Resilient elements 32 and 34, for example compression springs, are provided and disposed about the battery tube 26 on opposite sides of the laser head carriage 30. The outer end of compression spring 32 is in bearing engagement with a collar 36 that is affixed to the battery tube 26, and the outer end of compression spring 34 bears against collar 38 which extends outwardly from the forward wall of power supply module 24. Finally, mounting apparatus 28 includes a pneumatic buffer device 40 that is operably disposed between the laser head carriage 30 and the weapon 50 for absorbing and dissipating the energy of recoil to cushion the laser head 22 from shock.

In continued reference to FIG. 3, it will be observed that laser head 22 is attached to laser head carriage 30 by an arrangement of front and rear split ring clamps 42, 44 which are integrally formed with a plate 46 comprising holding means for the laser. Clamps 42, 44 extend around the circumference of laser head 22 (see FIG. 2) with ends 47, 48 of the clamps receiving screws 56, 58 which screw into plate 46, tightening the respective clamp around the tubular shaped laser head 22 to rigidly secure it to plate 46.

Laser head carriage 30 further includes a sliding carrier 60 adapted to be received upon battery tube 26 and be slidable thereon. Carrier 60 is a one piece structure having collar-like ends 62, 64 and a plate-like extension 66 therebetween. The collar-like ends 62, 64 have an internal diameter that is only very slightly larger than the outside diameter of the battery tube 26 on which they slide (see FIG. 4). Depending downwardly from the collar-like ends 62, 64 are lobed extensions 68, 70 which are adapted to receive the pneumatic device 40 therebetween. The lobes have holes, such as hole 69 shown in FIG. 4, drilled therein to accept the rod 72 of the pneumatic buffer device 40.

Plate 46 having laser head 22 secured thereon by clamps 42, 44 is pivotally attached to the sliding carrier 60 by a pivot arm bracket 74. So attached, plate 46, and consequently laser head 22, is provided with pivotal movement relative to sliding carrier 60 in the vertical plane of the apparatus. From the view of FIG. 2, pivot arm bracket 74 is seen to be an inverted U-shaped bracket having an upper surface that is contiguous with the lower surface of plate 46. The combined structure of laser head 22, plate 46 and pivot arm bracket 74, pivots around an axis defined by screw 76, 77 that fit into sliding carriage 60 (see FIG. 4) through ears 78, 80 of pivot arm bracket 74. Enlarged counter-bores are made in ears 78, 80 to permit pivoting of pivot arm bracket 74 therearound, yet, permit screws 76, 77 to be firmly engaged into sliding carriage 60. Pivotal movement of laser head 22 in the vertical plane as provided by pivot arm bracket 74 and the associated components provides the capability for elevation adjustment. Such adjustment is achieved by use of the pivot arrangement discussed above and the elevation adjustment mechanism 82 to be described in more detail with regard to FIG. 5.

In addition to elevation adjustment, it is also desirable to provide the laser aiming system with the capability of adjusting for windage variations. Accordingly, the illustrated embodiment includes such a feature by having plate 46 pivoted with respect to pivot arm bracket 74 about an axis that is perpendicular to that defined by screw 76, 77. As illustrated by the dotted lines in FIG. 3, and in greater detail in FIG. 4, such an axis for providing pivotal movement in the horizontal plane of the illustrated embodiment is provided by pivot mechanism 84.

Figure 4:
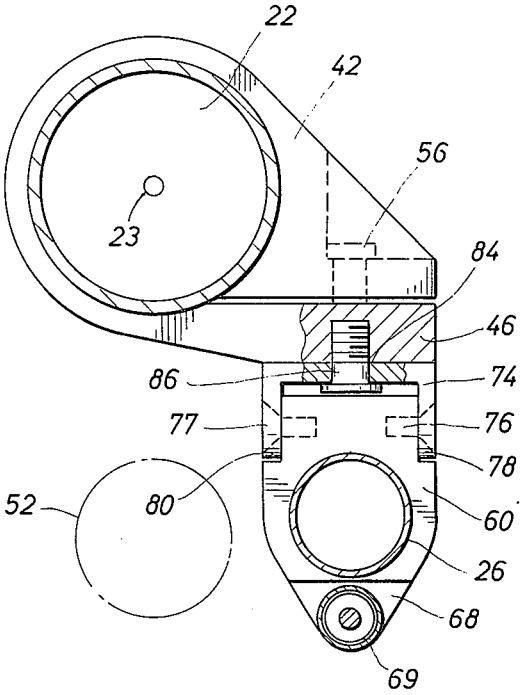
FIGS. 4 and 5 are cross-sectional views looking longitudinally of the laser aiming system shown in FIG. 3, illustrating the windage and elevation adjustment mechanisms associated with the illustrated embodiment of the present invention.

With reference to FIG. 4, the pivot mechanism 84 llustrated comprises a screw 86 having a flattened ıead position secured to the underside of the pivot arm ›racket 74 and a shank portion extending through the ›racket 74. A drilled and tapped hole in the underside ›f plate 46 receives the threaded portion of screw 86, ınd it is about the axis defined by screw 86 that the aser head 22 pivots. This arrangement permits the ılignment of the laser head opening 23 to be altered in ı lateral direction with respect to the barrel 52 of the veapon, to compensate for cross winds that will drive a ›rojectile laterally off target.

Figure 5:
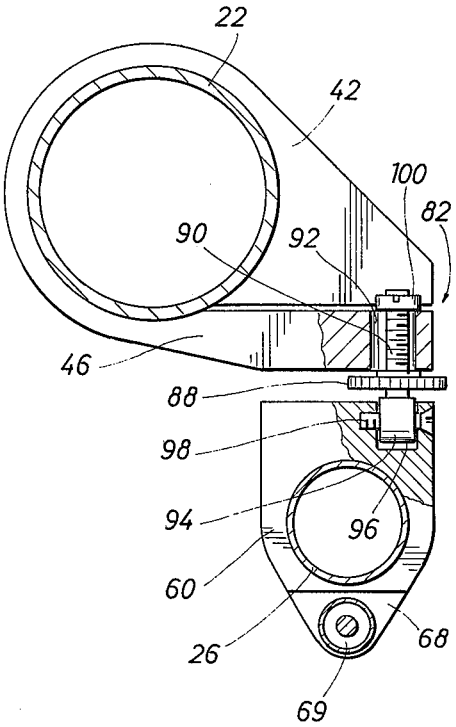

Turning now to FIG. 5, the elevation adjustment nechanism 82 is in full view in the cut-away, cross-sec- ional view presented therein. Elevation adjustment nechanism 82 serves not only to properly set the slope ›f laser head 22 with respect to barrel 52, but also to ock-down and prevent movement of the split-ring :lamp and plate structure that secures laser head 22 to aser head carriage 30. Specifically regarding elevation ıdjustment, which as previously discussed is provided ›y the pivotal movement of laser head 22 about screws '6, 77, there is provided a thumbwheel nut 88 that hreadably engages a threaded post 90 extending up- vardly from sliding carrier 60. The upper end of post )0 extends upwardly through a slot 92 in plate 46, and he lower end of post 90 attaches to a collar 94 that is lisposed in a recess 96 within sliding carrier 60. Collar )4 is secured in place within recess 96 by a counter- unk screw 98, which forms an axis about which stud )0 may pivot. Pivotal movement of post 90 in this man- ıer is necessary to permit the post to assume an in- :lined posture, as plate 46 is pivoted about the pivot ›oint defined by screws 76, 77 and changes inclination vith respect to the longitudinal axis of barrel 52 of veapon 50. Thumbwheel nut 88 is moved up or down long post 90 to set the proper elevation of laser head :2; and when the proper setting has been reached, ›ck-down screw 100 is tightened against the upper urface of plate 46 pressing plate 46 against a shoulder n the upper surface of thumbwheel nut 88, thereby ›cking the laser head 22 into position at the desired levation.

Slot 92 formed in plate 46, and through which ıreaded post 90 extends, is a laterally extending slot ermitting plate 46, to which laser head 22 is attached, › be secured at both front and rear locations. The slot 2 is necessary to permit plate 46, and consequently ıser head 22, to pivot about screw 86. When the de- ıred windage adjustment has been made, as by moving ıe laser head 22 about screw 86 to an oblique dispo- :tion with respect to the barrel 52 of weapon 50; lock- own screw 100 is then utilized to preserve the desired :tting.

Shown in FIGS. 6–9 is one suitable pneumatic buffer evice for absorbing and dissipating the energy of re- oil developed during firing of the weapon. The pneu- ıatic buffer device 40 is shown attached to laser head arriage 30 between the lobed extensions 68, 70 which epend from the collar-like ends 62, 64 of sliding car- er 60. The pneumatic buffer device 40 includes a ylinder 102 having a threaded end portion 104 that is eld within an opening 106 in lobed extension 70 by a :rew-on retainer 108. A sleeve 110 having a diameter ightly larger than cylinder 102 slips over cylinder 102 ıd covers a portion of the exterior thereof with a very nall gap between the inner surface of sleeve 110 and ıe outer surface of cylinder 102. Sleeve 110 has inter- nal threads on one end to receive a threaded plug 112, which plug has a threaded extension 114 that extends through the opening 69 in lobed extension 68 and is held in place therein by a threaded retainer 116. Threaded plug 112 has a bore 118, and threaded end 104 of cylinder 102 has a similar bore 120. Concentri- cally disposed within the cylinder 102 is a rod 72, which extends through the bores 118, 120 and has a cross-sectional area that is only minutely smaller than the cross-sectional area of the bores 118, 120.

Referring briefly to FIG. 3, the opposite ends of the rods 72 are received in recesses in the collar 36 and in the forward wall of the power supply module 24. So attached, the rod 72 is disposed in a generally parallel orientation with respect to the battery tube 26. As explained above, tube 26 forms a guide track for the laser head carriage 30 that has sleeve 110 and cylinder 102 securely attached thereto. Therefore, in order for the laser head carriage 30 to move along the elongate guide track defined by battery tube 26, it must also move relative to rod 72.

Referring once again to FIG. 6, piston 122 is shown concentrically disposed within cylinder 102 and about rod 72. From FIG. 7, it is observed that piston 122 is a cylindrical structure having four ducts 124, 125, 126, 127 which extend entirely through the piston. Retain- ing rings 128, 130 on opposite sides of piston 122 are disposed in grooves formed in rod 72 and prevent movement of piston 122 relative to rod 72. An end cap portion 132 abuts piston 122 and seals off the four ducts 124–127. End cap 132 is urged into abutment with piston 122 by a spring 134 that is compressed between end cap 132 and a retaining ring 136 disposed in a groove formed in rod 72. The end cap 132 includes first and second ports 138 and 140 which extend longi- tudinally through end cap 132 adjacent to rod 72. Fi- nally, an O-ring seal 142 is disposed in a groove around piston 122 and serves to seal off the chamber area defined within the confines of cylinder 102. The spring loaded end cap 132 forms a valve that opens in re- sponse to pressure buildup within the chamber 101 defined by cylinder 102 to release fluid contained therein through ducts 124–127.

Figure 9:
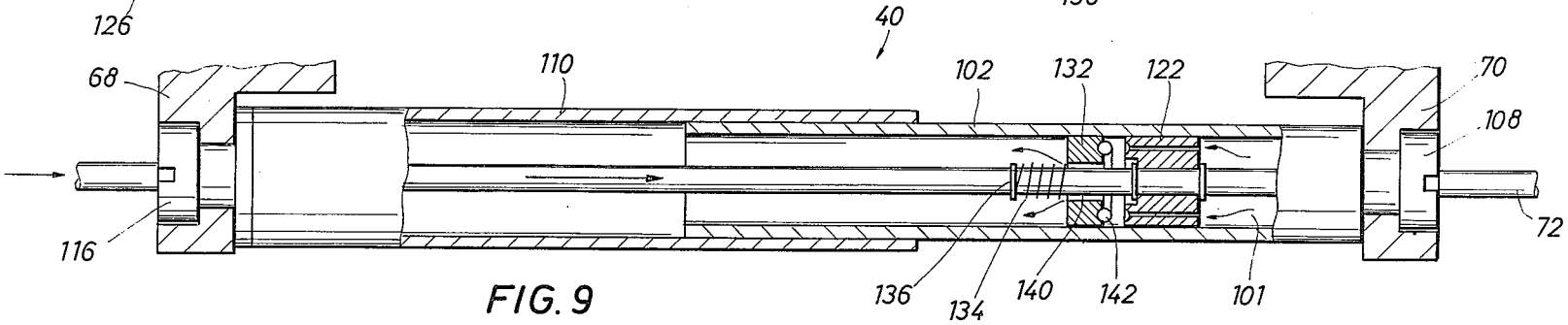

FIG. 9 illustrates the valve action of end cap 132 as rod 72 is moved relative to sleeve 110 and cylinder 102 in the direction indicated by the arrows. As rod 72 is moved, piston 122 is driven farther into cylinder 102, compressing the air therein. Although a small gap exists between the outer surface of rod 72 and the surface of bore 120, the gap is not sufficiently large to allow the release of a significant amount of air from chamber area 101. O-ring 142 protects against leakage from cylinder 102 around piston 122.

As the air within cylinder 102 is compressed, pres- sure will build up and exert a force on end cap 132. When the pressure is sufficiently large, end cap 132 will be forced away from piston 122 against the force of spring 134. Air from within cylinder 102 will then be able to escape through ducts 124, 125, 126, 127 in piston 122 and through ports 138, 140 in end cap 132 as indicated by the curving arrows. After end cap 132 opens, piston 122 acts as a pump, forcing almost all air out of chamber area 101.

When rod 72 is moved in the opposite direction after piston 122 has been driven into cylinder 102, the end cap 132 is held tightly against piston 122, covering up ducts 124–127. Air is forced out of the space within sleeve 110 and the rear portion of cylinder 102 through the gap existing between the interface of the two members. Simultaneously therewith, air is drawn back into chamber 101 through bore 120 around rod 72.

Compression of the air within chamber 101 and controlled release thereof through ducts 124–127 and ports 138, 140, by the valving action of end cap 132 and piston 122, provides the necessary physical mechanism to do work. The work required in moving piston 122 and compressing the air within chamber 101 absorbs energy created elsewhere that acts on piston 122 through rod 72.

Attachment of the laser aiming system 20 to the weapon 50 (see FIG. 1) may be accomplished by any suitable attachment means that can releasably secure the system to the weapon with the guide (i.e. battery tube 26) for laser head carriage 30 being held in fixed relation to the weapon 50.

Figure 10:
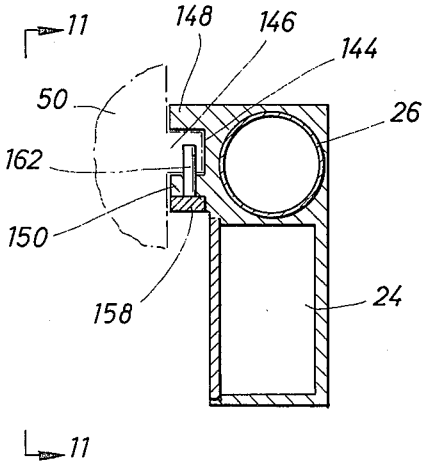
FIGS. 10 and 11 are views of the attachment mechanism for securing the laser aiming system to a weapon.
Figure 11:
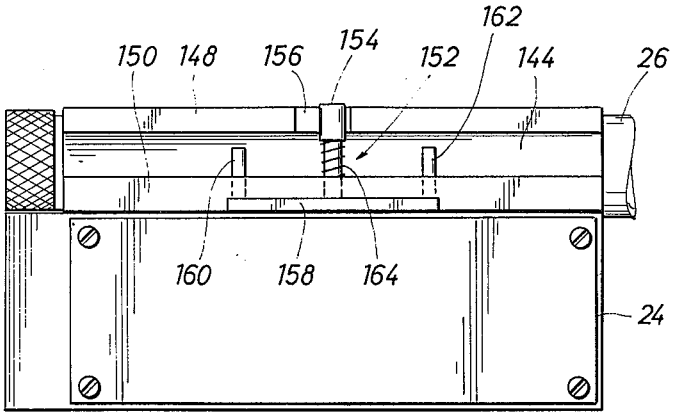
Figure 6:
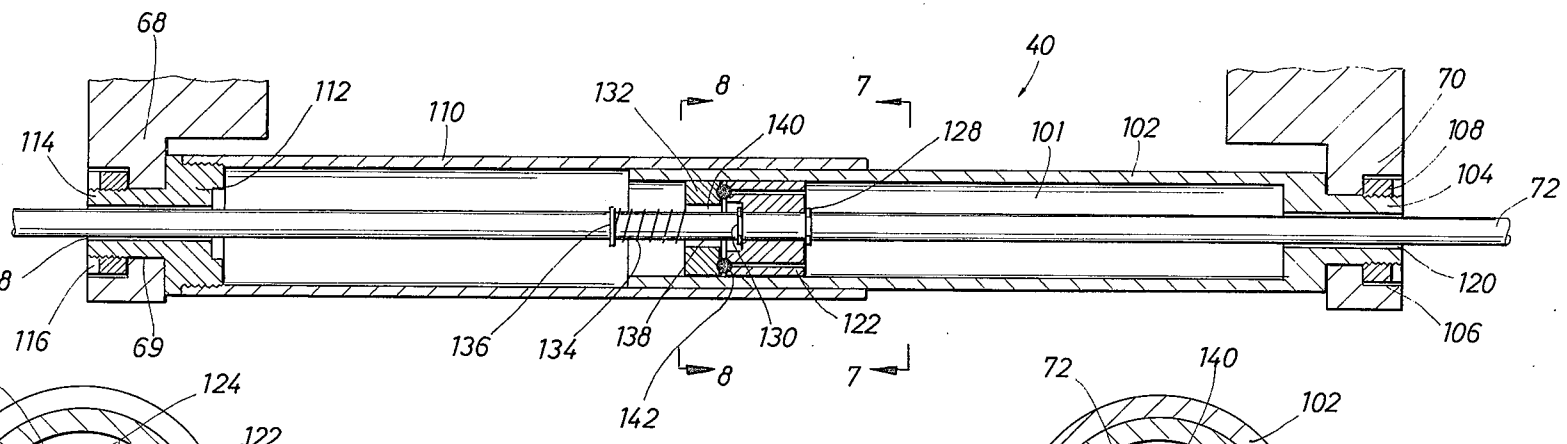
FIGS. 6–7 and 8–9 illustrate various aspects of the pneumatic shock absorber device utilized in the illustrated embodiment of the present invention.
Figure 8:
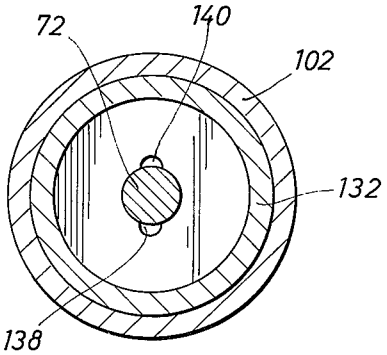
Figure 7:
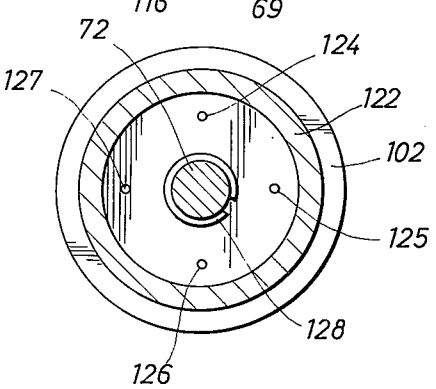

As shown in FIGS. 10 and 11, one suitable attachment means includes a guide channel 144 adapted to receive a mating lug 146 from weapon 50. Two outwardly extending rails 148, 150 define guide channel 144, which rails run substantially the entire length of power supply module 24 (see FIG. 11). A holding pin mechanism 152 is carried in rail 150 and serves to lock lug 146 into guide channel 144.

As seen in FIG. 11, holding pin mechanism 152 includes a post 154 that extends laterally across guide channel 144 and enters an opening 156 in rail 148. A base plate 158 disposed within a recess in rail 150 connects perpendicularly to an end of post 154. Two shorter holding pins 160, 162 attach perpendicularly to base plate 158 and extend through rail 150 into guide channel 144. A spring 164 disposed about post 154 spring loads the holding pin mechanism 152, urging the base plate 158 into seating engagement with the recess in rail 150 so that the short holding pins 160, 162 project into guide channel 144. Lug 146 is provided with holes drilled therein which are registerable with holding pins 160, 162 when lug 146 is properly guided into channel 144.

When it is desired to secure the laser aiming system 20 to the weapon 50, post 154 is depressed against the force of spring 164 to retract holding pins 160, 162, clearing guide channel 144 of obstructions. The mating lug 146 on weapon 50 is aligned with guide channel 144 and inserted therein. The holding pins 160, 162 are held in their retracted position until the proper location of the mating pieces (144, 146) is reached, whereupon the holding pin mechanism 152 is released with the pins 160, 162 snapping into the holes drilled in lug 146 that register with the placement of the holding pins.

To remove the laser aiming system 20 from the weapon 50, the holding pin mechanism 152 is depressed to retract the pins 160, 162 from engagement with the holes in lug 146, permitting the lug 146 to be removed from guide channel 144. It is in this manner that the illustrated attachment means releasably secure the laser aiming system 20 to the weapon 50 at the desired central location.

In operation, after laser aiming system 20 has been secured by the attachment means to the weapon 50, the laser head 22 upon being supplied with electrical power from power supply module 24 projects a beam of coherent light. Assuming that the laser has been sighted in by positioning it with respect to the barrel 52 of the weapon for proper windage and elevation parameters, the beam of light will strike a target positioned at a predetermined range from the weapon at the point of impact of a projectile that is fired from the weapon. This type of aiming permits the marksman shooting the weapon to accurately pinpoint his target in any type of prevailing weather conditions, day or night, although it is to be recognized that in bright sunlight the range will be limited. Further, this type of aiming permits firing of the weapon from any comfortable position.

Upon discharge of weapon 50, it is accelerated rearwardly. This accelertion develops what is termed recoil. Since the elongate guide 26 is disposed in fixed relation to the weapon 50 by the attachment means, it, too, is accelerated rearwardly with the weapon. Laser head carriage 30, however, being able to slide longitudinally on elongate guide 26, moves relative to the weapon 50. The forward compression spring 32 yieldably restrains movement of laser carriage 30 and provides some cushioning of the laser head 22 from recoil.

Rod 72, which is also disposed in fixed relation to weapon 50, drives piston 122 into cylinder 102 which is rigidly secured to laser carriage 30. Fluid pressure begins to build up ahead of piston 122 as it is driven further into cylinder 102, which fluid pressure acts as a yieldable resisting force against the movement of piston 122. After the pressure within cylinder 102 has reached a predetermined level, end cap 132 is urged away from its sealing engagement with the surface of piston 122 and uncovers air release ducts 124–127, permitting the controlled release of fluid from within cylinder 102. Recoil energy continues to drive piston 122 farther into cylinder 102 against the diminishing air pressure force.

The pneumatic buffer device 40 operably disposed between the weapon 50 and laser 22 serves to cushion the laser from recoil shock and prevents injury thereby expending recoil energy in performing the work of moving piston 122 into cylinder 102 against the opposing fluid pressure force of the air within the cylinder. As recoil subsides, compression springs 32 and 34 urge the laser carriage 30 toward the position with respect to elongate guide 26 that the carriage assumes prior to the firing of weapon 50.

The foregoing description of the invention has been directed to a particular preferred embodiment for the purposes of explanation and illustration. It will be apparent, however, to those skilled in this art that many modifications and changes may be made in the apparatus without departing from the scope and spirit of the invention. For example, the resilient elements shown as compression springs may be elastomeric blocks engaging the laser head carriage. Also, with appropriate changes in the sleeve and cylinder of the pneumatic device, a pressure relief valve could be positioned thereon to form an air release valve in place of the spring loaded end cap arrangement illustrated. It will be further apparent that the invention may also be utilized, with suitable modifications within the state of the art, with aiming devices other than lasers, such as optical telescopic sights. These, and other modifications of the invention, will be apparent to those skilled in the art. It is the applicant's intention in the following claims to cover all such equivalent modifications and variations as fall within the true spirit and scope of the invention.

What is claimed as new and desired to be secured by Letters Patent of the United States is:

1. An aiming system for attachment to a weapon having an elongate barrel which comprises:

a laser for projecting a beam of coherent light onto a target to indicate the impact point of a projectile fired from the weapon; and apparatus mounting said laser on said weapon in a manner such that the laser is free for limited longitudinal movement relative to the weapon generally parallel to said barrel, said apparatus including a pneumatic buffer device for cushioning said laser from shock upon recoil of the weapon, which comprises a cylinder held in fixed relation to the aiming device, and a piston disposed within said cylinder for longitudinal movement therein, said piston being operably connected to said weapon and having a valve mechanism operable in response to fluid pressure within the cylinder.

2. The system recited in claim 1 further comprising windage and elevation adjustment mechanisms for sighting in said laser at a predetermined target range.

3. The system recited in claim 1 further comprising a power supply module attached to said mounting apparatus for supplying electrical power to said laser.

4. The system recited in claim 1 wherein said laser is a helium neon gas laser.

5. An apparatus for mounting an aiming device to a weapon having an elongate barrel, comprising:

a mechanism for providing the aiming device with longitudinal movement relative to the weapon;

attachment means adapted to secure said mechanism to the weapon; and a pneumatic buffer device operatively connected to said mechanism for absorbing recoil energy to cushion the aiming device from shock upon recoil, said pneumatic device comprising a piston cylinder held in fixed relation to the aiming device, a piston disposed within said cylinder, having a valve mechanism operable in response to fluid pressure within said cylinder to release fluid contained therein, and a rod extending through said cylinder with said piston secured thereon, said rod being held in fixed relation to the weapon.

6. The apparatus of claim 5 wherein said mechanism comprises:

an elongate guide secured by said attachment means in fixed relation to the weapon;

a carriage having means thereon to hold said laser and adapted to embrace said elongate guide for reciprocating movement thereon; and a resilient mechanism yieldably resisting longitudinal movement of said carriage and urging said carriage to an intermediate position between the opposite ends of said elongate guide.

7. The apparatus of claim 6 wherein said resilient mechanism comprises a pair of compression springs disposed about said elongate guide on opposite ends of said carriage.

8. The apparatus of claim 6 wherein said pneumatic buffer device is operably connected between said carriage and said elongate guide.

9. The apparatus of claim 6 wherein said holding means is attached to said carriage for pivotal movement in the vertical and horizontal planes of the weapon; and said apparatus further comprises a windage and elevation adjustment mechanism for positioning said holding means with respect to the weapon so as to sight in the aiming device at a predetermined target range.

10. An apparatus for mounting a laser being used as an aiming device to a weapon having an elongate barrel, comprising:

an elongate guide having attachment means formed thereon to secure said guide in fixed position relative to the weapon and substantially parallel to the elongate barrel of the weapon;

a carrier adapted to embrace said elongate guide for longitudinal reciprocating movement relative to said guide;

holding means having clamps for embracing the aiming device, said holding means being attached to said carrier for pivotal movement in the vertical and horizontal planes of the weapon relative to the barrel of the weapon;

windage and elevation adjustment mechanism connected between said holding means and said carrier for positioning said holding means relative to the weapon to sight in the aiming device at the desired target range;

a pair of compression springs disposed about said guide at opposite ends of said carrier to yieldably resist movement of said carrier relative to said guide and urge said carrier to intermediate position between opposite ends of said guide; and a pneumatic buffer device arranged to absorb recoil energy and cushion the aiming device from shock, said pneumatic buffer device comprising a piston cylinder connected to said carrier;

a rod extending through said cylinder affixed to the elongate guide by a clamp;

a piston disposed in said cylinder and secured on said rod, said piston having fluid release ducts formed therein;

an end cap movable along said rod and urged into abutment with said piston by a spring to seal off the fluid release ducts, said end cap serving as a valve mechanism to release fluid from said cylinder through the air release ducts in said piston in response to fluid pressure build-up within said cylinder.

* * * * *